United States Patent [19]

Boschian

[11] Patent Number: 4,909,509

[45] Date of Patent: Mar. 20, 1990

[54] VIBRATION DAMPERS FOR TENNIS RACKETS

[76] Inventor: Louis Boschian, 2 Allee De La Brague, Les Hauts De Vaugrenier, 06270 Villeneuve-Loubet, France

[21] Appl. No.: 191,444

[22] Filed: May 9, 1988

[30] Foreign Application Priority Data

May 13, 1987 [FR] France ..... 87 06810

[51] Int. Cl.[4] ..... H63B 51/00

[52] U.S. Cl. ..... 273/73 D; 273/73 R

[58] Field of Search ..... 273/73 R, 73 C, 73 D, 273/73 E, 73 F, 73 G, 73 K, 73 L, 73 J

[56] References Cited

U.S. PATENT DOCUMENTS 4,575,083 3/1986 Adam ..... 273/73 D
4,627,635 12/1986 Koleda ..... 273/73 J X
4,761,007 8/1988 Boschian ..... 273/73 D
4,776,590 10/1988 Krent et al. ..... 273/73 D

FOREIGN PATENT DOCUMENTS 3504137 8/1986 Fed. Rep. of Germany ... 273/73 D
1398833 4/1965 France ..... 273/73 D

*Primary Examiner*—Edward M. Coven
*Assistant Examiner*—William E. Stoll
*Attorney, Agent, or Firm*—Morgan & Finnegan

[57] ABSTRACT

A device for damping vibrations in strung rackets includes a first pair of opposed plates and a central body portion which connect the plates. The body portion is receivable in the space defined by two pairs of intersecting racket strings such that the plates grip at least two racket strings. The device further includes a second pair of plates removably attachable to the device, each of the second pair of plates being generally parallel and opposed to one of the plates in the first pair. The device further includes means for removably attaching additional plates such that when the device is mounted on a racket there is a series of parallel, opposed plates extending axially from each side of the racket face. Because the plates may be readily added or removed, and may be of different sizes, the vibration damping effects of the racket may be tuned to meet a particular player's needs.

9 Claims, 2 Drawing Sheets

VIBRATION DAMPERS FOR TENNIS RACKETS

BACKGROUND OF THE INVENTION

1. Field of the Invention

This invention relates to devices for vibrations in tennis rackets at the moment of impact of the ball on the racket strings.

2. Description of the Related Art

It has been known for some time, that this impact generates in the entire racket frame, including the handle, a vibratory system having high frequency components. These high frequency vibrations cause fatigue and lesions in many players.

Starting from the study of this phenomenon, different solutions have been put forward to eliminate or at least reduce these vibrations. In considering the phenomenon, it must be recognized that although such vibrations exist in all rackets. they are spread out in a different manner depending on the constitution of each racket. Thus, a damping device can be efficient with one racket and much less efficient with another. In addition, different players will generate different vibrations using the same racket because of the players' different strengths and level of impact they are able to generate.

The disadvantages of known damping devices are they are not at all general-purpose, i.e. of universal application, because of the great variety of the rackets and their manner of use.

The object of the invention is to remove these disadvantages by providing a damping device having means for adjusting the vibration damping according to a player's desires.

SUMMARY OF THE INVENTION

In accordance with the above objects, the subject invention is directed to a vibration damping device for a strung racket comprising a central body, a pair of spaced apart, substantially parallel plate members extending from the central body for gripping a pair of parallel racket springs in the space between the plates.

In accordance with the invention, the device further includes adjustment means for removably attaching at least one additional plate to either side of the device. Thus, when the device is mounted on the racket face a series of substantially opposed, parallel plates extend axially from either racket face in a direction substantially normal to each racket face. The particular sizes of the plates may be selected to tune the device's vibration damping effects to the particular characteristics of the racket. Preferably the plates are made from an elastomeric material.

In another embodiment of the invention, instead of just two plates which are adapted to grip the racket springs, the damping device also includes a second pair of plate members each being spaced apart and substantially parallel to one of the plates in the first pair of plates. These additional plates act as an aerial, allowing the damping of high frequency components of the vibrating system. In accordance with this embodiment, the damping device also includes means for adding additional plate members on either side of the racket string surface. By adding such additional plates, which may vary in size, a player may particularly adjust the vibration damping to best suit the particular vibration system generated by the player.

The invention will be now described in detail, referring to the accompanying drawings.

DESCRIPTION OF THE PREFERRED EMBODIMENTS

Referring to the Figures, the damping device of the subject invention includes a main body 1, with a square crossection, having approximately the size of a stitch of the strings of the racket, made of the two pairs of strings C1-C'1 and C2-C'2, widthwise and thicknesswise.

Integral with this main body 1 is a pair of identical plates 2 and 3 which grip the strings. Preferably, the plates are made of an elastomeric material. The mounting of the device is effected by the distortion of the plates elastomeric material.

As shown in the Figures, a second pair of identical plates 4 and 5, having a diameter smaller than the plates 2 and 3, is also a die casting in only one piece with the main body 1. These auxiliary plates 4 and 5 are intended to reduce the high-frequency vibrations of the racket.

Figure 1:
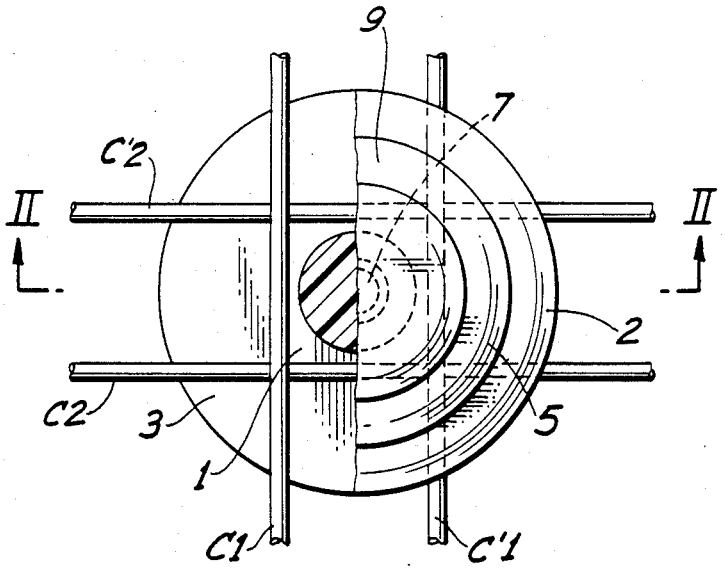
FIG. 1 is a top plan view of the invention, partly in section.
Figure 2:
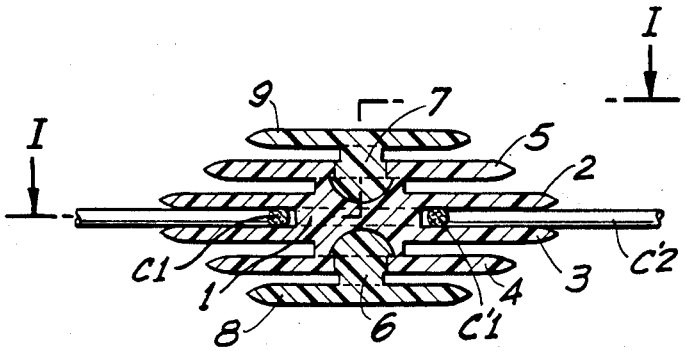
FIG. 2 is a cross-section of the FIG. 1.
Figure 3:
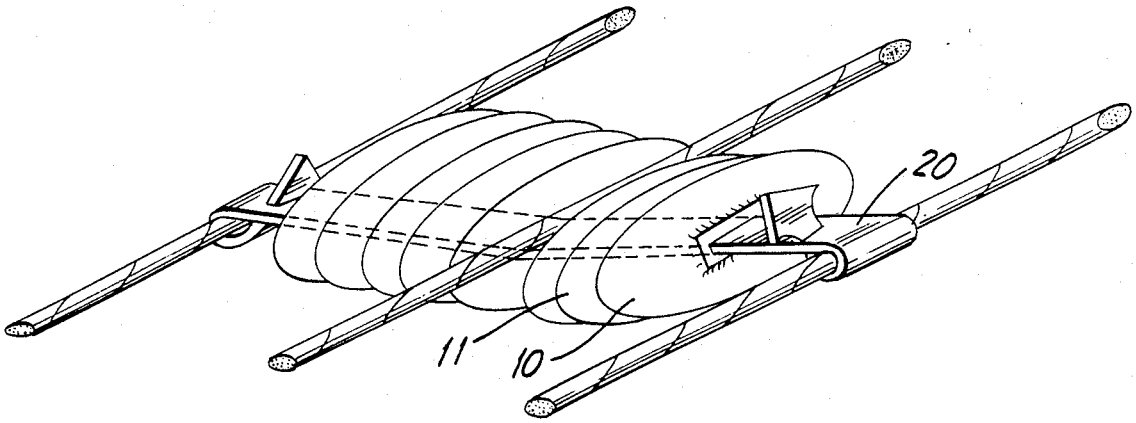
FIG. 3 illustrates another embodiment of the invention.

In regard to the essential characteristic of the invention (adjustability of vibration damping) as shown in FIG. 2, each of the external plates 4 and 5 contains a stud 6 (and 7) fixed on a plate 8 (and 9). The diameter of these plates can be chosen by the player according to the characteristics of the specific racket to be used. This interchangeability for the elements 6-7 and 8-9 allows the changing of the resonance characteristics of the device, and consequently the resulting damping of the racket vibrations.

In comparison with known systems, the device according to the invention presents a two-fold advantage:

(1) to damp the high frequency vibrations, with the external plates, which are not in contact with the strings, and which act as "aerials". These external plates are not indispensable to the invention but may be preferably used in certain applications. In addition their shape and size are not necessarily as shown in the drawing but rather can be modified to achieve the best vibration dampening in a particular application. Instead of one only pair of external plates, it is possible to set several pairs, in order to eliminate all the harmonics of the vibratory system:

(2) to be adjustable, in order to choose correctly the removable plates or elements. These elements can be mounted on the main body by different means, not only studs. However, to maintain the adjustability it is necessary that these means permit the ready attachment and removal of these elements. The shape and the size of these elements may be modified according to the specific characteristics of each racket, and even according to the playing style of the user. The essential characteristic of the invention is to allow such an adaptation which is only possible with this device.

Even though the previous description referred to the plates 2-3-4-5-8-9 which were shown as disks, the plates can, of course, take some other different geometrical shape such as for example a triangular shape.

I claim:

1. An apparatus for damping vibrations in a strung racket having a racket face and opposed impact surfaces, said face including a plurality of spaced apart long strings extending in the direction of the length of the racket and a plurality of spaced apart cross strings which intersect said long strips and are disposed along the width of the racket face, said apparatus comprising:

a first pair of substantially parallel plate members, said plate members having substantially opposed inner surfaces;

a body portion disposed between and connecting said plate members, said body portion being receivable in the space defined by two pairs of intersecting long and cross strings such that when said body is so received, the plate members grip at least two strings of said intersecting two pairs of strings between the opposed inner surfaces of said plates; and a second pair of plate members removably attachable to the apparatus such that each plate of said second pair is disposable in spaced apart opposed relationship with one of said plates in the first pair of plates.

2. An apparatus as recited in claim 1 wherein said plate members are generally triangular in configuration.

3. An apparatus as recited in claim 1 which further includes means for removably attaching additional plate members to the apparatus such that when the apparatus is mounted on the racket a series of opposed, parallel plates disposed substantially normal to each impact surface extend axially from each impact surface for tuning the vibration damping effects of the apparatus.

4. An apparatus as recited in claim 3 wherein said first and second pairs of plates and said additional plates are circular in configuration, with the plates progressively decreasing in diameter from each impact surface to the plate disposed axially the farthest from each respective impact surface.

5. An apparatus as recited in claim 4 wherein said body portion includes an undercut aperture and each said plate in said second pair of plates includes a stud having a head portion receivable in said undercut aperture such that each such plate member in the second pair of plates may be snapped into and out of the body.

6. An apparatus as recited in claim 5 wherein each plate in said second pair of plates and each additional plate member further includes an undercut aperture for receiving the stud portion of one of said additional removable plate members such that a series of spaced apart plates can be assembled outwardly from either impact surface of the racket.

7. An apparatus for damping vibrations in a strung racket having a racket face and opposed impact surfaces, said face including a plurality of spaced apart long strings extending in the direction of the length of the racket and a plurality of spaced apart cross strings which intersect said long strings and are disposed along the width of the racket face, said apparatus comprising:

a first pair of substantially parallel plate members, said plate members having substantially opposed inner surfaces;

a body portion disposed between and connecting said plate members, said body portion being receivable in the space defined by two pairs of intersecting long and cross strings such that when said body is so received, the plate members grip at least two strings of said intersecting two pairs of strings between the opposed inner surfaces of said plates;

a second pair of plate members fixed to said body portion, each plate in said second pair being spaced apart from and substantially opposed to one of the plates in said first pair of plate members; and a third pair of plates removably attachable to said second pair of plates, each plate of said third pair of plates being spaced apart from and substantially opposed to one of the plates in said second pair of plates.

8. An apparatus as recited in claim 7 which further includes means for removably attaching additional plate members to the apparatus such that when the apparatus is mounted on the racket, there is a series of substantially parallel opposed plate members extending away from each racket impact surface in a direction substantially normal to each racket impact surface.

9. An apparatus as recited in claim 8 wherein each of said plate members is circular in configuration with the plate members decreasing in diameter from each racket impact surface to the plate member disposed axially the farthest from each racket impact surface.

* * * * *

UNITED STATES PATENT AND TRADEMARK OFFICE

CERTIFICATE OF CORRECTION

PATENT NO. : 4,909,509

DATED : March 20, 1990

INVENTOR(S) : Louis Boschian

It is certified that error appears in the above-identified patent and that said Letters Patent is hereby corrected as shown below:

Claim 1, column 3, line 4, change "strips" to -- strings --.

Signed and Sealed this

Thirtieth Day of July, 1991

*Attest:*

HARRY F. MANBECK, JR.

*Attesting Officer*

*Commissioner of Patents and Trademarks*